US007062210B2

(12) United States Patent
Van Den Kerkhof et al.

(10) Patent No.: US 7,062,210 B2
(45) Date of Patent: Jun. 13, 2006

(54) PRINTER COMPRISING AN ENDLESS BELT AS AN INTERMEDIATE MEDIUM

(75) Inventors: Franciscus M. G. Van Den Kerkhof, Maasbree (NL); Maurice G. M. Wilms, Panningen (NL)

(73) Assignee: OCE-Technologies B.V., Venlo (NL)

( * ) Notice: Subject to any disclaimer, the term of this patent is extended or adjusted under 35 U.S.C. 154(b) by 56 days.

(21) Appl. No.: 10/808,516

(22) Filed: Mar. 25, 2004

(65) Prior Publication Data

US 2004/0190962 A1 Sep. 30, 2004

(30) Foreign Application Priority Data

Mar. 27, 2003 (NL) ..... 1023029

(51) Int. Cl.
*G03G 15/20* (2006.01)

(52) U.S. Cl. ..... 399/308; 399/302

(58) Field of Classification Search ..... 399/121, 399/297, 302, 308; 430/48, 56, 126
See application file for complete search history.

(56) References Cited

U.S. PATENT DOCUMENTS

| | | | |
|---|---|---|---|
| 5,409,557 | A | 4/1995 | Mammino et al. |
| 5,573,104 | A | 11/1996 | Kibayashi et al. |
| 6,336,025 | B1 | 1/2002 | Saeki |
| 6,704,535 | B1 * | 3/2004 | Kobayashi et al. ..... 399/308 |

FOREIGN PATENT DOCUMENTS

| | | |
|---|---|---|
| EP | 0 671 671 B1 | 9/1995 |
| EP | 1109072 | 6/2001 |
| JP | 11-249450 | 9/1999 |
| JP | 2001-042662 | 2/2001 |

* cited by examiner

*Primary Examiner*—Hoang Ngo
(74) *Attorney, Agent, or Firm*—Birch, Stewart, Kolasch & Birch, LLP

(57) ABSTRACT

A printer provided with a unit for forming an image and an endless intermediate belt trained under tension around rollers in such manner that the belt can rotate over the rollers, the intermediate belt being operatively connected to the said unit for transfer of the image from the unit to a receiving material, wherein the belt comprises a fabric of threads as a support, the threads of the fabric being so positioned that when the intermediate belt rotates, a deviation of said belt axially is substantially independent of the tension.

12 Claims, 6 Drawing Sheets

PRINTER COMPRISING AN ENDLESS BELT AS AN INTERMEDIATE MEDIUM

This non-provisional application claims priority under 35 U.S.C. § 119(a) on Patent Application No. 1023029, filed in The Netherlands on Mar. 27, 2003, which is herein incorporated by reference.

BACKGROUND OF THE INVENTION

The present invention relates to a printer provided with a unit for forming an image and an endless intermediate belt trained under tension around rollers in such manner that the belt can rotate over the rollers, the intermediate belt being operatively connected to the image forming unit for transfer of the image from the image forming unit to a receiving material, wherein the intermediate belt comprises a fabric of threads as a support.

A printer of this kind is known from European Patent EP 0 671 671 B1. The image-forming unit of this printer comprises an endless photoconductor on which an image of toner particles can be formed by successively charging the photoconductor, exposing it image-wise and developing the resulting latent image with toner. This image is then transferred in a first transfer step to an endless intermediate belt. This belt consists of a polyester fabric provided with a 2 mm thick silicone rubber top layer. The belt is trained under tension around a number of rollers, one of which serves as a drive roller. Using the drive roller, the belt can be rotated over the rollers so that the image can be transported to a subsequent transfer location. Here the belt is brought into contact with a receiving material, the image being transferred under the influence of temperature and pressure from the belt to the receiving material. Any residues of the image on the intermediate belt are removed by means of one or more cleaning rollers.

One disadvantage of this known printer is that there is always a certain loss of image register because of the transport of the image by the intermediate belt. In other words, it is never entirely certain where the image will finally arrive on the receiving material. In addition, there will always be some degree of image distortion, for example deformation of a straight line to a somewhat curved line. The reason for this is not completely clear but it is known that the problems can be reduced by using a belt control mechanism. Known belt control mechanisms are, for example, passive mechanisms such as flanges, by means of which any deviation of the belt in the axial direction, i.e. the direction parallel to the roller axes, is limited, or the use of rollers which are self-controlling. Using such rollers which are, for example, somewhat bevelled at the ends, it has been found that the belt stays within certain limits. Active belt control mechanisms often use a roller in which the position of the axis can be changed. By a slight change of this position the belt can actively be controlled in the axial direction.

These known belt control mechanisms solve the above-mentioned problems only to a restricted degree. In addition, each of the above-mentioned mechanisms has additional disadvantages. Flanges against which a belt runs may damage the belt. Self-controlling rollers have only a restricted working area and active control mechanisms require complex measuring and regulating mechanisms and are hence relatively expensive, and in addition they do not solve the problem of image distortion.

SUMMARY OF THE INVENTION

The object of the present invention is to obviate the above disadvantages by providing a printer wherein the threads of the fabric are so positioned that when the intermediate belt rotates, a deviation of the belt axially is substantially independent of tension.

Experiments have shown that the positioning of the threads in the fabric of the support has an important influence on the registration and/or image distortion in the known printer. This can be interpreted as follows. It has been found that the belt, even if belt control mechanisms are provided, oscillates to some extent when it rotates. In other words, the belt has deviations in the axial direction. Of itself, an oscillation of this kind need not necessarily result in print artefacts because it would be possible to take this into consideration in forming the image. However, Applicants have found that the oscillation in known printers is dependent on the tension to which this belt is subjected. Although broadly speaking, this tension can be kept constant, local tension variations may occur, for example because rollers are not completely round or because the belt does not have exactly the same thickness throughout. Since the oscillation is dependent on a tension which changes unpredictably, it can never be predicted with 100% certainty how the belt will oscillate and accordingly what deformation an image will experience going from a first transfer location to a second. Applicants have found that this tension-dependent oscillation is a consequence of the positioning of the threads of the fabric in the belt support. Thus it has been found in known printers, which has been supplied as the Océ 3165, that the fabric is a network of threads which gives rise to a tension-dependent deformation of the belt and hence a tension-dependent oscillation of the belt. A "fabric of threads" does not simply mean a fabric as known from the said printer. In principle, any set of one or more threads, which set can serve as a support for an intermediate belt as a result of the manner in which said one or more threads are positioned, comes under these terms. By obtaining a thread positioning such that the oscillation is independent of tension, the objective of the present invention is reached. Positioning the threads in such a manner can be effected in many ways. It is possible to determine experimentally whether the thread positioning is such that the oscillation of the belt is substantially independent of the tension under which the belt rotates. Applicants have found that if the tension under which the belt rotates is varied a deviation of the belt in the axial direction may change approximately 5 mm maximum in order to achieve good register and suppress image distortion. Applicants would point out that even with the known belts, certain circumstances may result in a situation in which the belt, without using belt control mechanisms, exhibits little to no oscillation, for example 1 to 5 mm. However, Applicants have found that this situation can be achieved with one constant belt tension. As soon as the belt tension changes, the belt will exhibit a different oscillation.

In one embodiment, wherein the fabric comprises one or more threads which extend substantially in the peripheral direction of the belt, said one or more threads extend over a length L equal to the periphery of the belt in the axial direction over a distance D equal, at maximum, to three percent of the length L. A conventional type of fabric consists of a set of threads extending in the axial direction, being situated at substantially identical distances from one another (warp threads) and one thread which extends substantially in the peripheral direction of the belt and runs as a helix from one side of the belt to the other side of the belt (weft thread). As a variant of this, there may be a set of threads extending substantially in the peripheral direction, at identical distances from one another. There is therefore not a single thread present in helix form in the peripheral direction, but a large set of individual threads, substantially parallel to one another, which set starts with a first thread at one side of the belt and terminates with a last thread on the other side. Applicants have found that in the known belts, despite the fact that they are often made with very accurate looms, there is always a certain deviation from the ideal thread configuration of the thread or threads extending in the peripheral direction of the fabric. It has been found that this thread or threads during one revolution around the fabric, i.e. equal to the length L of the belt, extend more in the axial direction than might be expected because of their theoretical positioning. An extension of this kind occurs, for example, if a thread over its entirety deviates from its theoretical position, for example because said thread is skewed with respect to the peripheral direction. Such skewing can occur during the weaving process by the weft thread insertion direction not being accurately adjusted. It may also be that a thread has a deviation to a varying degree in the axial direction locally, for example because of an irregularity in the fabric. A local deviation of this kind might be the result of a weaving error but also the result of positioning processes in the loom, which are inherent in the type of fabric. If, for example, use is made of one weft thread, it will always have to turn time and time again during the weaving process. The point where the thread turns in the fabric belt may result in a local deviation of the thread in the axial direction. Such deviations are often referred to as the "skewing" of threads in the fabric. Applicants have found that this skewing is combined with a tension-dependent oscillation and hence a loss of registration and/or image distortion. If, however, the fabric is such that said one or more threads extend axially over a distance D equal at most to 3% of said length L during one revolution around the belt, i.e. over a length L, then there may be said to be a substantially tension-independent deviation of the belt.

In another embodiment, the distance D is between 0.1% and 1% of the length L. It has been found that a further reduction of the distance D results in an improvement of the register and reduction of image distortion. However, it has surprisingly been found that a very small distance D, namely less than 0.1%, in turn results in a deterioration of the belt behaviour. In other words, if the thread or threads extending in the peripheral direction have practically a theoretical position (an exact helix in the case of one weft thread or threads which are situated perfectly in the peripheral direction), it appears that the behaviour of a belt carried by this fabric is not optimal. It has been found that the behaviour of the belt deteriorates in the course of time. Even under loads of just some tens of thousands of revolutions of the belt it has been found that the latter is frequently damaged at the side, for unexplainable reasons, so that the belt running and hence register and/or image distortion are adversely affected. In this embodiment, in which there is therefore a specific minimum deviation of the threads in the axial direction, this problem can be obviated.

The present invention also relates to a method of making an intermediate belt suitable for use in the printing method as described above. This process comprises weaving threads into a fabric belt, after-treating the fabric belt, wherein the threads are repositioned, maintaining the resulting position of the threads and finally applying a top layer to the fabric belt. The recognition of the fact that the position of the threads in the fabric is an important factor for the register and image quality that can finally be achieved with a belt in which this fabric is used as a support, shows that it is advantageous to extend the existing method of making fabric belts by extra process steps in which the threads, after the fabric belt has been made, are re-positioned and this new position is substantially fixed. Thus it is possible to make a belt in which the oscillation of a side of said belt during its rotation is substantially independent of the tension under which said belt runs. Repositioning of the threads can be effected in many ways.

In one embodiment of this method, the resulting new position is fixed by the application of the top layer. The latter may, for example, be a rubber which is applied in non-hardened form to the fabric belt and possibly pressed even partially through the fabric. After the hardening of the rubber, the position of the threads is substantially fixed. This embodiment is advantageous because in this way two process steps can be performed in one step. Also, in this way no additional means are required to fix this position after the repositioning of the threads.

In another embodiment, wherein the fabric belt comprises one or more threads which extend substantially in the peripheral direction of the fabric belt, the after-treatment of the fabric belt is effected by raising the fabric belt tension in such manner that the said one or more threads experience a tensile stress in the peripheral direction. As explained above, the type of fabric in which one or more threads extend in the peripheral direction of the belt is possible. In particular, the type in which this one thread is the one which runs as a helix from one side of the belt to the other side, is very common and hence readily obtainable and relatively cheap. It has been found that the position of such thread (or threads) in particular influences the final register and image quality that can be obtained with a belt in which this fabric serves as a support. It has been found that the position of said thread (or threads) can easily be improved by raising the tension of the fabric belt, for example by training it around two parallel rollers and moving said rollers apart in the tangential direction so that the fabric is stretched. Particularly a thread extending in the peripheral direction of the belt will thus be inclined to be straighter. Straighter in this context means a positioning in which said thread during one revolution around the belt exhibits a less small deviation in the axial direction. The thread is as it were pulled straight and inequalities in the thread run are eliminated to a substantial degree. In this way existing fabrics can very easily be after-treated so that when used as a support in an intermediate belt for a printer they result in intermediate belts with which a high print quality can be obtained.

In another embodiment, the one or more threads extending substantially in the peripheral direction of the fabric belt are made of a plastic which has a softening temperature, and the fabric belt is heated during the tensioning process to above said softening temperature. In this way the threads are stretched at a temperature at which they are easily deformed. Surprisingly, this results in an improvement of the repositioning process. Despite the fact that the threads in this embodiment are much more pliable and hence during a stretching process probably result in an intensification of deviations from the ideal position or an actual introduction of a deviation, it has been found that this is not the case with the fabric belts described.

In yet another embodiment, the periphery of the fabric belt is increased during the tensioning process, whereafter the tension is reduced until a situation is reached in which the fabric belt has a required periphery, which situation is maintained through a predetermined time, whereafter the fabric belt is cooled to below the softening temperature. In this embodiment, during the repositioning process the fabric belt is first over-stretched, whereafter the belt is brought to the required final periphery with the reduction of the tension under which it is stretched. In this case the belt is always under stretching tension but it will decrease further in the course of time. It has been found that by maintaining this situation for a predetermined time a very adequate repositioning finally takes place. The fabric belt is then cooled to below the softening temperature so that the threads can hardly deform further, if at all. As a result the position of the threads is fixed to a significant degree.

In another embodiment, the threads are interrupted in the vicinity of the edges of the belt. When used in a printer, the edges of the belt often come into contact with printer components, for example flanges, shafts, sensors and so on. There is a risk that threads of the fabric which are situated just on the surface of said edges will be gripped by such a component so that the threads are pulled out of the belt if the belt rotates further. To prevent a long thread from being pulled out of the belt, such long thread being capable, for example, of winding around a shaft and thus disturbing the further running of the belt or even causing stoppage of a shaft, the threads are interrupted in the vicinity of the edges. In this way it is practically impossible for a long fabric thread to be pulled out of the belt. Such an interruption can be achieved, for example, by notching or perforating the belt. Each edge could for example be provided with one or more notches in the form of a semicircle.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The invention will now be explained in the drawing with reference to the following Examples.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

Figure 1:
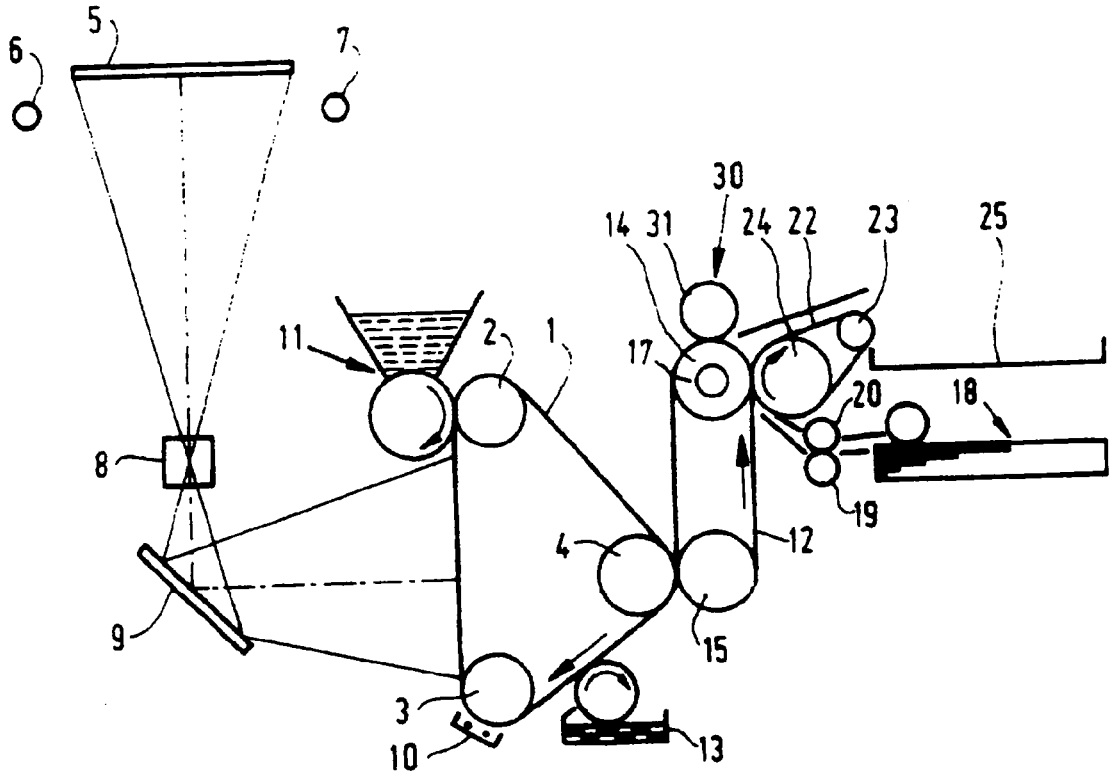
FIG. 1 diagrammatically shows a printer provided with an intermediate belt for transferring a toner image.

The printer is provided with a unit for forming a toner image, said unit comprising an endless photoconductive belt 1. This belt is rotated in the indicated direction at a uniform speed using drive and guide rollers 2, 3 and 4. In the embodiment illustrated, the printer comprises analogue means in order to project onto the photoconductor 1, using flash lights 6 and 7, lens 8 and mirror 9, an image of an original (not shown) placed on the easel 5. Prior to this imaging, the photoconductor is electrostatically charged by means of a corona unit 10. The optical imaging of the original on the charged photoconductor results in the formation of a latent charge image on said conductor, as is adequately known from the prior art. This charge image is developed with toner powder transferred to the photoconductor with the use of a developing unit 11, comprising a magnetic brush. This results in the formation of a toner image on said photoconductor. In a first transfer zone this image is brought into contact under pressure with an endless intermediate belt 12, which is trained around the rollers 15 and 14 under tension. This belt comprises a fabric of threads as a support and is provided with a soft and heat-resistant elastomer layer applied thereto, for example a silicone, EPDM or PFPE rubber. As a result of the contact in the first transfer zone, which takes place at a temperature of typically 40 to 70° C., the toner image is transferred from the photoconductor 1 to the intermediate belt 12. After this transfer, any remaining toner particles are removed from the photoconductor 1 using a cleaner roller 13. The photoconductor is then ready for re-use.

The intermediate belt 12 is trained under tension over the rollers 14 and 15, the image being passed from the first transfer zone to a second transfer zone where the intermediate belt 12 is in contact with a pressure-application belt 22. Belt 22 is trained over rollers 23 and 24. Roller 24 is placed under pressure in the direction of belt 12. In this transfer zone, a receiving material (not shown) originating from tray 18 and guided by rollers 19 and 20, is brought into contact with the intermediate belt 12, the receiving material being so guided that it is situated in register with the toner image on the intermediate belt 12. At the second transfer zone the temperature of the intermediate belt is such, by the use of heating element 17, that the toner particles are to some extent tacky and readily deformable. As a result of this, the toner particles transfer from the intermediate belt 12 to the receiving material and are rigidly combined with said material. After the image has been transferred, the printed receiving material is deposited in the output tray 25 intended for this purpose. Any residues of toner particles on the intermediate belt are removed by the use of a cleaner roller 30 which has a surface 31 which picks up toner particles. A roller of this kind is known, for example, from U.S. Pat. No. 4,607,947.

The intermediate belt in the printer according to this example is constructed with an endless fabric belt of polyester threads containing a 2 mm thick layer of a peroxide-hardened silicone rubber. A top layer of 50 μm of a softer silicone rubber is applied to said 2 mm thick layer. A belt of this kind is known from EP 0 146 980. The production of a belt of this kind is known in the prior art, for example from U.S. Pat. No. 3,554,836.

The printer of this example is provided with analogue means in order to image an original on the photoconductor. It should be clear that other means than those illustrated, for example digital means which can use a page-width printhead provided with light emitting diodes (LED's) may be suitable for creating a charge image on the photoconductor. Also, an image-forming unit using a photoconductor may be dispensed with. The important feature is that an image is formed and that this image is transferred in any way whatsoever to the intermediate belt.

In the example illustrated, there is only one intermediate belt. It is obvious that use can also be made of a plurality of intermediate belts or other means, in addition to the intermediate belt, to transfer images in order finally to transfer the image to the receiving material. The form of transfer of the image as illustrated, by means of contact transfer, is one of the many possibilities. Other techniques are possible, for example contact-less techniques, in which particles are transferred by the use of an electric field.

Figure 2:
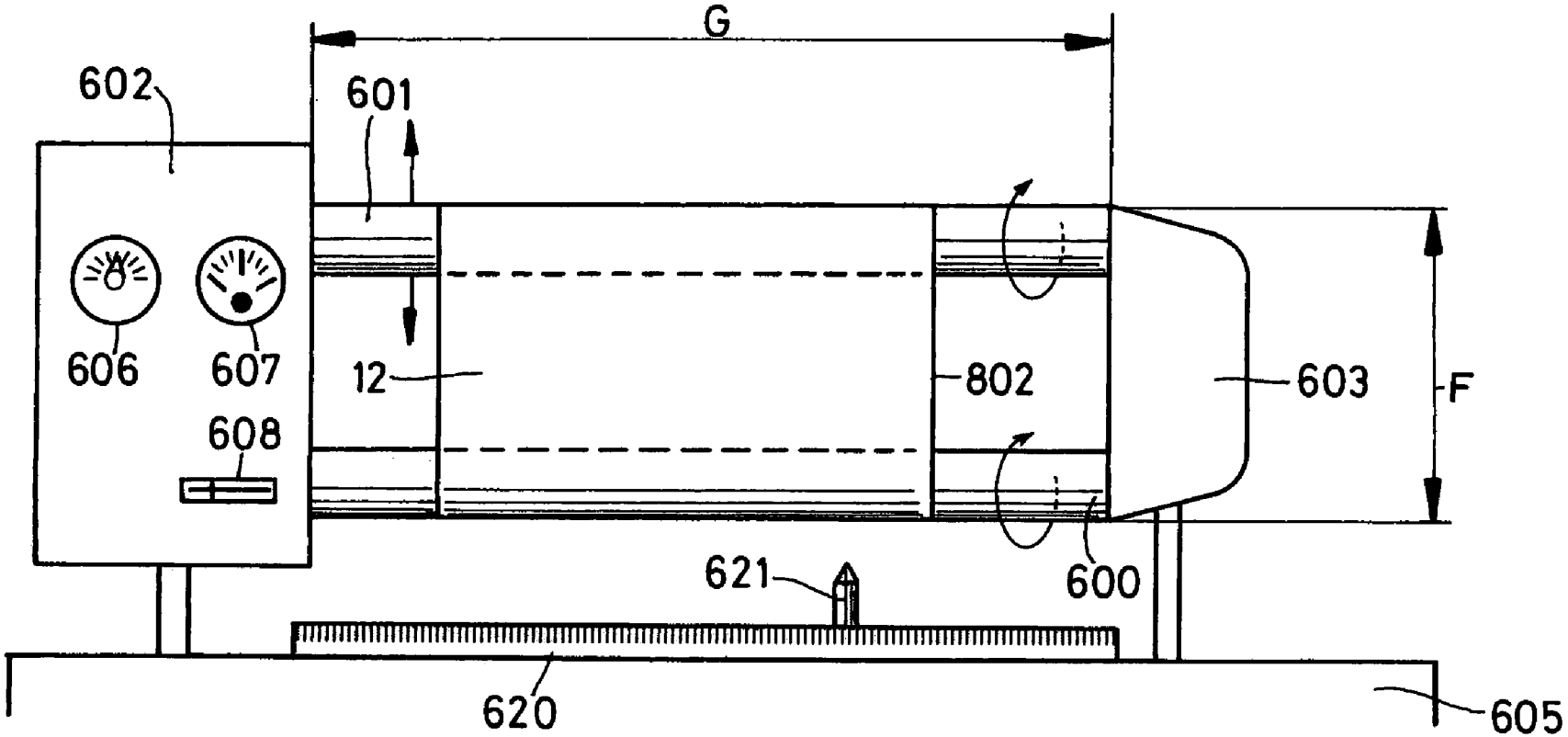
FIG. 2 diagrammatically shows a device with which the tension-dependency of the deviation of a intermediate belt in the axial direction can be determined.

FIG. 2 diagrammatically illustrates a device with which it is possible to determine whether an intermediate belt 12 has a deviation in the axial direction substantially independent of the tension under which the intermediate belt revolves. The device comprises two steel rollers 600 and 601 having a diameter of 80 mm and a length G of 600 mm. The rollers are kept at a mutual distance F apart by suspension in the end pieces 602 and 603. The whole is carried by plate 605. The two rollers are rotatable about their axis as indicated in the drawing. Roller 600 can be driven by means (not shown) situated in end piece 602. The speed of the roller can be controlled by adjusting means 606. Roller 601 is freely rotatable.

Roller 600 occupies a fixed position with respect to the two end pieces. Roller 601 can be moved in the directions indicated with respect to roller 600. In this way distance F can be varied between 203 and 218 mm. This distance can be adjusted using slide 608. The movement of roller 601 is effected by the use of pneumatic means which are located in the end pieces 602 and 603 (not shown). The force required to keep the rollers a specific distance apart can be read off on meter 607. This force can be varied between 0 and 2000 N. Meter 607 is so calibrated that the deadweight of roller 601 and any belt trained around the rollers 600 and 601 cannot be read off as a measurable force.

Trained around the rollers is an intermediate belt 12 of a width of 500 mm and a peripheral length of 670 mm. The belt comprises a fabric of polyester threads as a support and a silicone rubber a few millimeters thick as a top layer. This intermediate belt can be trained around the rollers 600 and 601 by minimising the distance F, whereafter the intermediate belt 12 can be pushed over end piece 603. Roller 601 is then moved away from roller 600 until it is possible to read on the meter 607 that the force required for this is distinctly greater than 0 N. At that time the belt becomes tensioned. The distance F is then so increased until the tension is equal to 25 N. The force with which a part of the belt can be stretched is 12.5 N (because this 25 N tensile force is distributed over two halves of the belt). Since the belt is 500 mm wide, it is also possible to state that the tension with which the belt is trained around the rollers is equal to 12.5 N/500 mm=25 N/m. When carrying out this measurement, it is important that the belt should initially be so placed so that the side 802 of the intermediate belt 12 is substantially parallel to a direction perpendicular to the axes of rollers 600 and 601 as indicated in the drawing.

The device further comprises a measuring unit 620 provided with a measuring head 621. Inter alia, in this way it is possible to measure the axial position of a point on the side 802 of the intermediate belt 12.

After the tensile force has been set to 25N, the belt is rotated at a speed of 6.6 m/min. During the rotation the tensile force is maintained at 25 N. Using the head 621, the oscillation of the side 802 of the intermediate belt 12 is determined. The oscillation is the difference between the minimum and maximum distance which the belt occupies with respect to the end piece 602 at the location of said measuring head. This oscillation is then also determined at a tensile force of 375 N and a tensile force of 750 N. In this way the oscillation is determined in the range from 25 to 750 N for a belt 500 mm wide, corresponding to a tension in the belt itself of 25–750 N/m. These are tensions which are typical for the use of an intermediate belt in a printer. In addition to these oscillations, it is also possible to determine the oscillation at intermediate tensile forces.

After the oscillations have been determined in the above-mentioned range of tensile forces, the maximum difference in the measured oscillations is determined. If this difference is less than 5 mm, i.e., approximately 1% of the width of the belt in this example, the oscillation is substantially independent of the tension at which the belt rotates. If the present invention is fully utilised, it is possible to achieve oscillation differences in the above range which are less than 2 or even 1.5 to 1.0 mm.

A tension-dependent oscillation of the belt will often occur in accordance with a tension-dependent deviation of the side of the belt as described above. A tension-dependency of this kind has the effect, in practice, of a loss of registration accuracy. However, it is also possible that the tension-dependency of the oscillation will only occur in the center of the belt. It could also be said that this is then the case of a tension-dependent deformation of the belt, the belt deviating (undergoing deformation) in the axial direction to a varying degree at the location of the oscillation. A tension-dependent deformation of this kind, for example, can result in image distortion. This type of oscillation can be measured by providing the belt with a circular marking in the peripheral direction, for example, a continuous line, the oscillation from said marking being determined as a function of the tension with which the belt is trained around the rollers.

Figure 3:
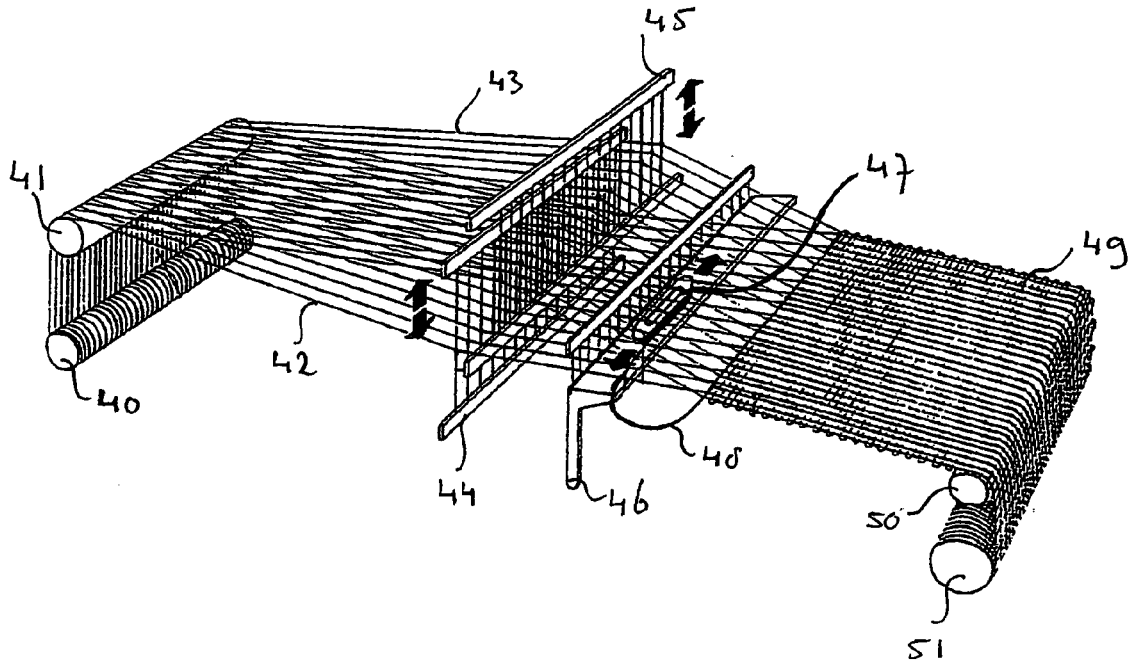
FIG. 3 diagrammatically illustrates a loom.

FIG. 3 diagrammatically shows a loom with which it is possible to make fabric which can serve as a support for an intermediate belt of a printer. A loom of this kind comprises a roller 40 on which threads are wound which are spaced equal distances from one another on the roller. These threads, which are termed the warp threads, are passed on via guide roller 41 to holders 44 and 45. Two such holders are provided in this loom and separate the warp threads into a first set of threads 42 and a second set of threads 43. The holders create a space between these two sets and in this space a shuttle 48 can move over a sley 46. A weft thread 47 is fixed to said shuttle. When the shuttle moves from a first side of the loom to a second side thereof, the weft thread is woven between the two sets of warp threads. After this movement, the holders change position, so that set 42 changes places with set 43. The shuttle then makes a return movement, the weft thread again being woven between the two sets. In this way a fabric 49 is formed which is wound on the collecting roller 51 via guide roller 50. An endless fabric belt can be made from such a fabric, for example by welding the two ends of a strip of said fabric. In a fabric belt of this kind, the warp threads are situated in the peripheral direction of the belt. A disadvantage of this process is that a weld seam forms so that there is a discontinuity with respect of properties. Another way of making an endless fabric belt is to weave a tubular fabric, this being possible by using four holders (instead of two) as is sufficiently known from the weaving art. By cutting off a part of the tube, an endless fabric belt is obtained which can serve as a support for an intermediate belt for a printer. In a fabric belt of this kind, the weft thread is situated in the peripheral direction of the belt, said weft thread forming a helix which extends from one side of the belt to the other. In this case the warp threads are in the axial direction of the belt.

Figure 4A:
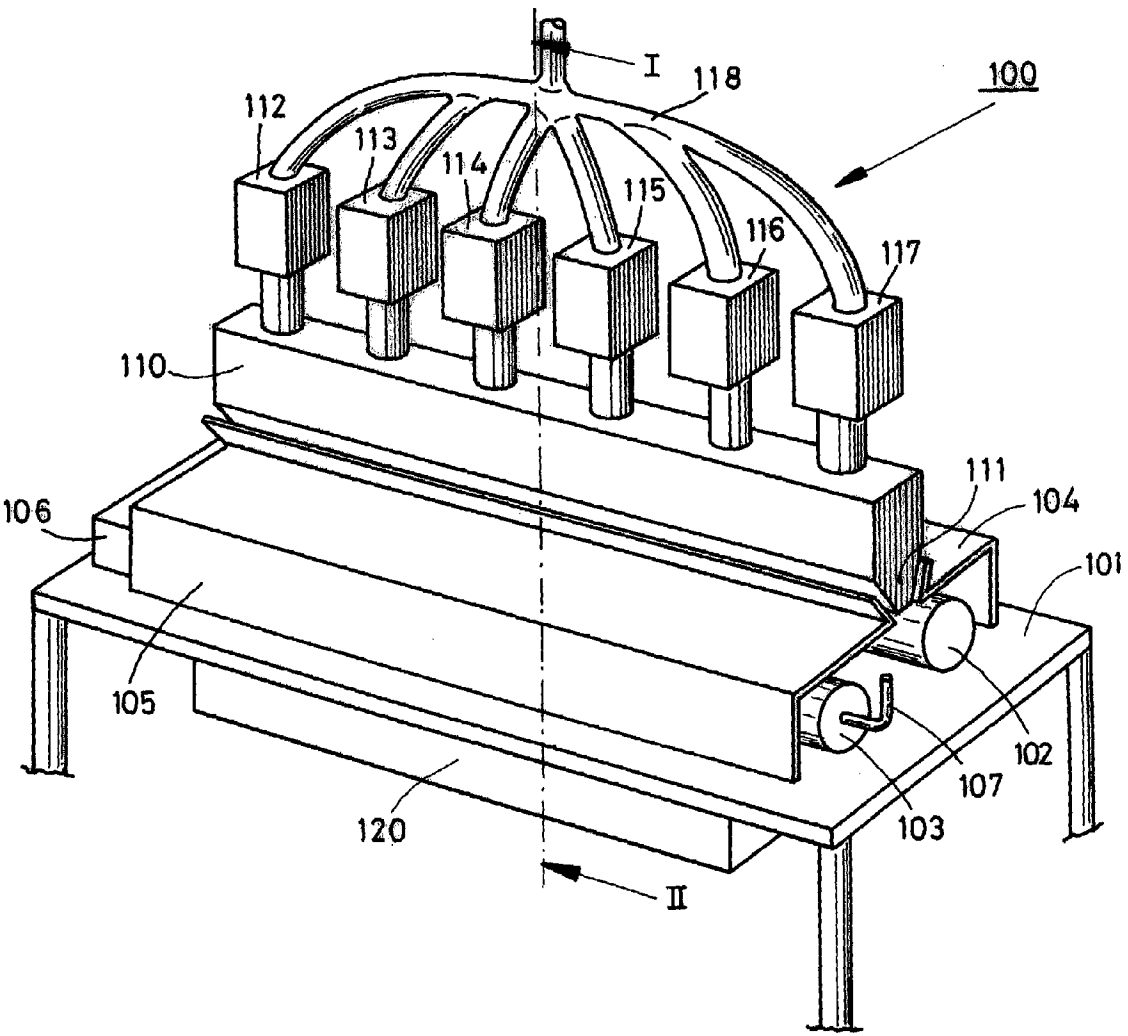
FIG. 4 is a diagram showing a device suitable for repositioning the threads of a fabric.
Figure 4B:
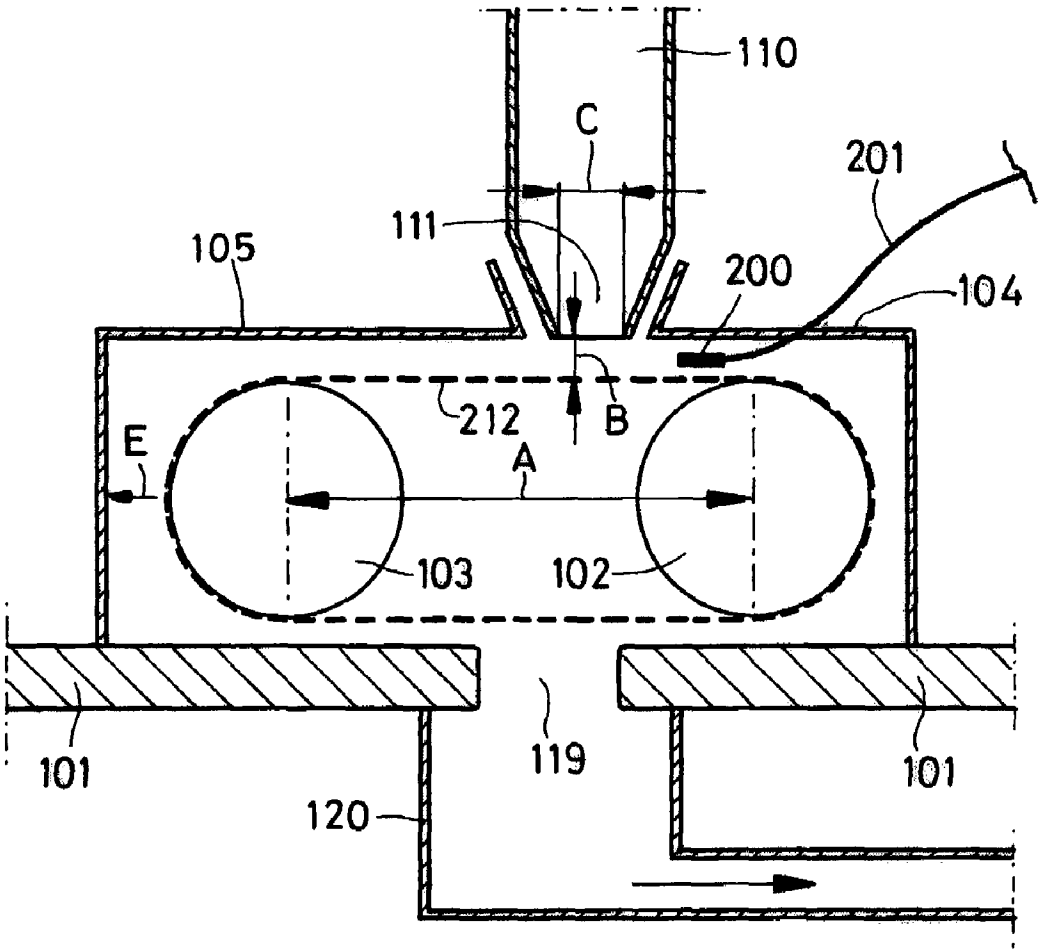

FIG. 4A diagrammatically illustrates a device suitable for repositioning the threads of a fabric to give a fabric with which it is possible to make an intermediate belt according to the present invention. FIG. 4B shows the same device as FIG. 4A in cross-section.

The device 100 comprises a support plate 101 and a pair of parallel rollers 102 and 103. Each of these rollers is one meter long and has a diameter of 79.5 mm. Two protective caps 104 and 105 are mounted around the rollers. Roller 102 is freely rotatable while roller 103 is driven by a drive unit 106. The latter roller is movable in a direction parallel to the surface of plate 101 and perpendicular to its axis. For this purpose the roller is provided with a handle 107. Mounted above the rollers is a unit for heating a fabric trained over the rollers 102 and 103. This unit comprises a distribution cap 110 provided with a nozzle 111. Above the cap 110 are six hot-air blowers 112 to 117 connected via a set of lines 118 to a pump (not shown) by means of which air can be blown through the hot-air blowers and finally nozzle 111. Air is extracted at the bottom of the device 100 by means of a suction extraction unit 120.

FIG. 4B is a cross-section of device 100 on the line I-II of FIG. 4A. This cross-section shows how a fabric belt 212, in this case a non-welded belt in which the warp threads are made of a polyester (polyethylene terephthalate, PET) and the weft thread are made of a polyether (polyether-ether-ketone PEEK) is trained around the rollers 102 and 103. The warp threads have a thickness of approximately 220 μm, and the weft thread has a thickness of approximately 250 μm. The distance between the warp threads (center-to-center) is approximately 0.8 mm. The weft thread is so woven that the pitch of the helix is approximately 0.8 mm per revolution around the belt. This results in a fabric with substantially square meshes having a mesh width of approximately 0.6 mm (0.8 mm minus the thickness of the threads). The length of the belt (in the peripheral direction) in this example is 672 mm. The distance between the rollers, indicated as A, is 210.5 mm. This distance can be increased by 7.5 mm by moving roller 103 in the indicated direction E. At the location of such an extraction unit 120, plate 101 is provided with an opening 119 through which air can be discharged. The distance B between the nozzle 111, which has an opening C 15 mm in size, and the fabric belt 212 is 10 mm. Just above the fabric belt there is disposed a thermocouple 200 connected via line 201 to a measuring and control unit (not shown). The temperature of the fabric belt 212 can be controlled by means of this unit.

To re-position the weft thread, the fabric belt is first of all tensioned to some extent by moving roller 103 in direction E. In this example a 1 to 2 mm displacement is sufficient. In this way the belt is so tensioned that it can be driven and will rotate. Using the drive the belt is rotated at a speed of 5 meters per minute. Air is then blown over the fabric belt at a rate of approximately $4m^3$ per minute. This air is heated by means of the hot-air blowers to a temperature of about 190° C., which is about 40° above the glass transition temperature of PEEK. As soon as the fabric belt has acquired a temperature of about 180° C., roller 103 is moved as far as possible in direction E. In this way the fabric belt is stretched to a length of about 686 mm. This situation is maintained for 1 minute, whereafter roller 103 is moved back in the direction of roller 102 until distance A is equal to 215.5 mm. The periphery of the fabric belt is now 681 mm. This situation is maintained for 4 minutes. The hot-air blowers are then switched off. As soon as the thermocouple 200 indicates that the fabric belt is 70° C., the protective caps 104 and 105 are removed so that the fabric belt cools even more rapidly. After a few minutes the drive for roller 103 is stopped. As a result of the process of heating the fabric belt above the glass transition temperature, a repositioning of the weft thread is obtained according to the present invention. The cooling process ensures that the acquired position of the thread is maintained. After this treatment the fabric belt is ready for further processing to form an intermediate belt for a printer.

Figure 5:
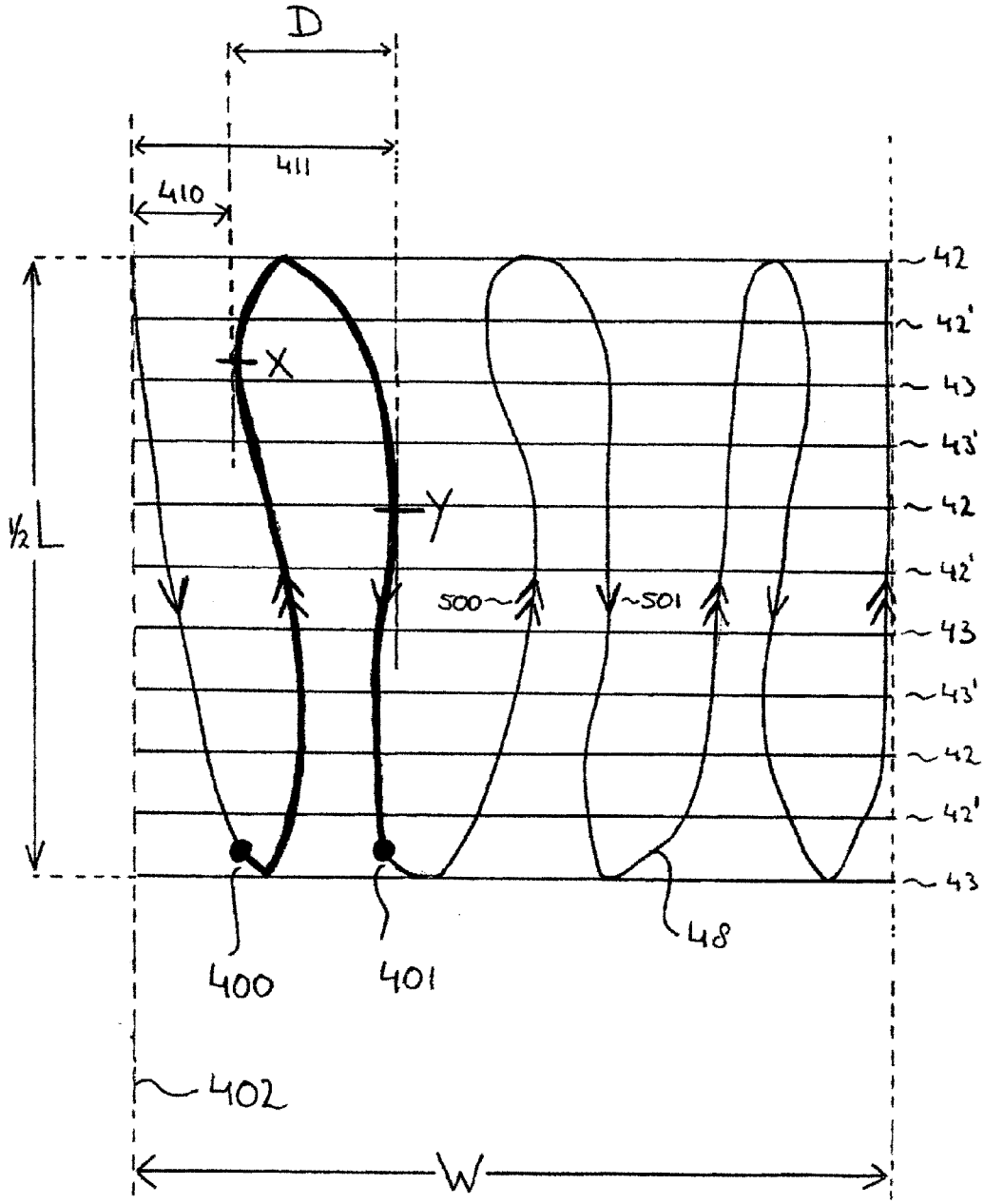
FIG. 5 diagrammatically illustrates a fabric belt.

FIG. 5 diagrammatically illustrates a fabric belt where only a very small number of threads is indicated. The drawing shows how it is possible to determine the distance D, which is an indication of the oscillation of the thread which extends substantially parallel to the peripheral direction of the belt.

The drawing shows an endless and non-welded fabric belt pressed flat in the drawing plane. The width of this flattened belt is equal to W, which is also the actual width of the belt in the axial direction. The length of this flattened belt is ½L, i.e. half the length of said belt in the peripheral direction. The drawing thus shows two layers of fabric situated one upon the other. The top fabric layer consists of the warp threads 42 and 43 (which extend in the axial direction) and those parts of the weft thread 48 which are indicated by the double arrows 500 (from the bottom to the top in the drawing). It will be seen that the weft thread extends substantially parallel to the peripheral direction of the belt. The bottom fabric layer consists of the warp threads 42' and 43', and those parts of the weft thread 48 which are indicated with the single arrows 502 (from top to bottom in the drawing). At the outermost warp threads, i.e. where the weft thread changes direction, the top layer of fabric merges into the bottom layer.

In order to determine the distance D over which the weft thread extends axially over a length L equal to the periphery of said belt, the following procedure is adopted. First of all, the weft thread 48 is marked over a distance L (hence over one revolution around the belt), in this example using a dark-colored marker. In the drawing this is indicated by the dark-marked part of the weft thread 48 which extends between the starting point of the marking 400 and the end point 401. Those points of this marked part are then determined which are situated at a minimum distance from the side 402 and at a maximum distance from said side. In this example these are points X (at a distance indicated as 410 from the side 402) and Y (at a distance 411 from the side 402). The difference between the distances at which these points are situated from the side 402 is equal to D. This distance can be determined for any arbitrary part of the weft thread having a length equal to L. In one embodiment this distance is at least equal to 0.1% of the length L of the belt and equal at maximum to 1% of length L.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printer provided with a unit for forming an image and an endless intermediate belt trained under tension around rollers in such a manner that the belt can rotate over the rollers, said intermediate belt operatively communicating with said unit for the transfer of the image from said unit to a receiving material, wherein the belt comprises a fabric of threads as a support, the threads of the fabric being positioned substantially parallel to the peripheral direction of the belt so that when the intermediate belt rotates, a deviation of said belt axially is substantially independent of said tension.

2. The printer according to claim 1, wherein the fabric comprises one or more threads which extend substantially in the peripheral direction of the belt, wherein said one or more threads extend over a length L equal to the periphery of the belt in the axial direction over a distance D equal, at a maximum, to three percent of the length L.

3. The printer according to claim 2, wherein the distance D is between 0.1% and 1% of the length L.

4. A method of making an intermediate belt suitable for use in a printer which comprises:

weaving threads to form a fabric belt, after-treating the fabric belt wherein the threads are repositioned, maintaining the resulting position of the threads and applying a top layer to the fabric belt.

5. The method according to claim 4, wherein the position obtained is fixed by the application of the top layer.

6. The method of claim 5 wherein the top layer is a rubber which is applied in a non-hardened form to the fabric belt where it is hardened to fix the position of the threads.

7. The method according to claim 4, wherein the fabric belt comprises one or more threads which extend substantially in the peripheral direction of the fabric belt and the after-treatment is effected by increasing the fabric belt tension in such a manner that the said one or more threads experience a tensile stress in the peripheral direction.

8. The method according to claim 7, wherein the said one or more threads are made of a plastic having a softening temperature, wherein the fabric belt is heated during the tensioning process to above said softening temperature.

9. The method according to claim 8, wherein the periphery of the fabric belt is increased during the tensioning process, whereafter the tension is reduced until a situation is reached in which the fabric belt has a required periphery, which situation is maintained for a predetermined time, whereafter the fabric belt is cooled to below the softening temperature.

10. The method of claim 9, wherein during the repositioning of the threads and prior to cooling, the fabric belt is first over-stretched, whereafter the belt is brought to required final periphery with a reduction of the tension under which it is stretched.

11. The method according to claim 4 wherein the threads are interrupted in the vicinity of the edges of the belt.

12. The method of claim 11 wherein the interruption is achieved by notching or perforating the belt.

* * * * *